US006203389B1

(12) United States Patent
Pearson

(10) Patent No.: US 6,203,389 B1
(45) Date of Patent: Mar. 20, 2001

(54) BODYBOARD

(76) Inventor: Eric Todd Pearson, 101 Treetop Dr., Melbourne, FL (US) 32951

( * ) Notice: Subject to any disclaimer, the term of this patent is extended or adjusted under 35 U.S.C. 154(b) by 0 days.

(21) Appl. No.: 09/382,111

(22) Filed: Aug. 24, 1999

(51) Int. Cl.[7] ..... B63B 35/73
(52) U.S. Cl. ..... 441/65
(58) Field of Search ..... 441/65, 74; 114/290; D21/769, 770

(56) References Cited

U.S. PATENT DOCUMENTS

| | | | | |
|---|---|---|---|---|
| D. 194,646 | * | 2/1963 | Del Mar | D21/769 |
| D. 220,979 | * | 6/1971 | Belik | D21/769 |
| D. 305,144 | * | 12/1989 | Shanelec | D21/769 |
| 3,342,154 | * | 9/1967 | Le Marec | 114/290 |
| 5,224,890 | * | 7/1993 | Moran | 441/65 |
| 5,634,834 | * | 6/1997 | Cole | 441/65 |
| 5,944,570 | * | 8/1999 | Appleby | 441/74 |

* cited by examiner

*Primary Examiner*—Sherman Basinger
(74) *Attorney, Agent, or Firm*—Robert J. Van Der Wall

(57) ABSTRACT

Disclosed is a substantially rigid to semi-rigid, lightweight bodyboard, having a durable, slick outer skin on the lower surface, a conventional upper surface and a specially shaped lower surface for maximized speed, maneuverability, and performance. The lower surface of the bodyboard at the nose has a slightly rounded or elliptical shape that is almost a flat surface which changes to a shallow trimaran hull shape in the rear two thirds of the bodyboard. The shallow trimaran includes a center hull and two sidehulls each separated by a channel and is characterized by inverse sharp edged chines at the inside edges of the side hulls to provide grip, tracking and maneuverability. The shallow trimaran is also modified by edge skegs termed infins that end abruptly before the tail to provide the bodyboard incredible hold and eliminate slide out. The shallow trimaran effect is tapered out with a slope so that it tends to flatten out towards the tail, which causes a planing effect generating lift and also trapping air to minimize wetted surface area and reduce friction. The sidehulls of the shallow trimaran have a lesser draft than the center hull such that lateral leaning causes one channel and adjacent sidehull to come out of the water to reduce wetted surface area reducing friction and increasing speed.

20 Claims, 1 Drawing Sheet

FIG. 1
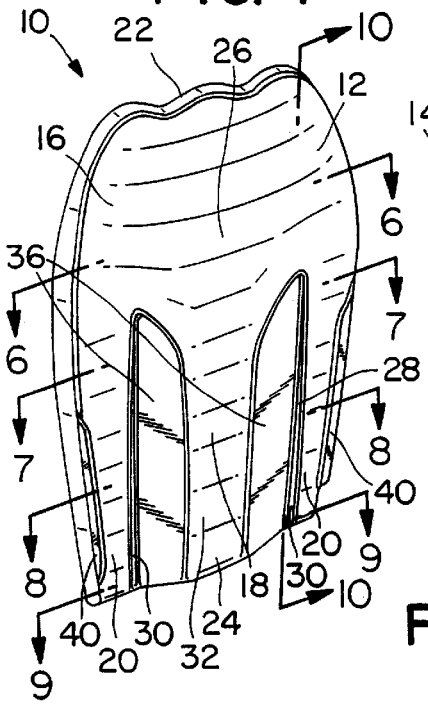
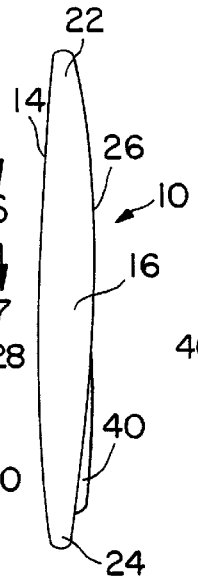
FIG. 2
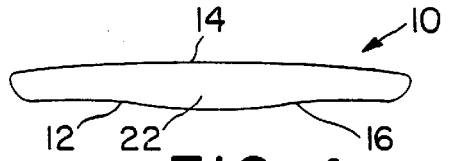
FIG. 4
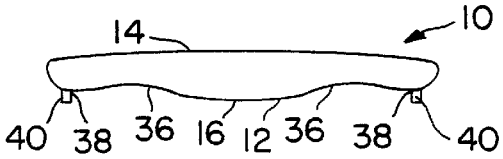
FIG. 5
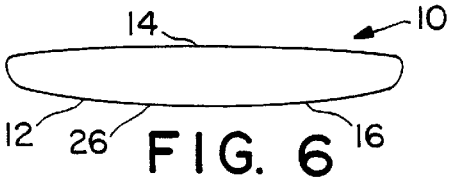
FIG. 6
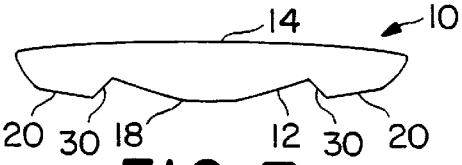
FIG. 7
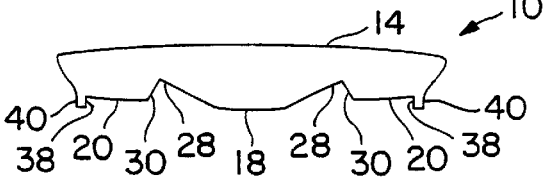
FIG. 8
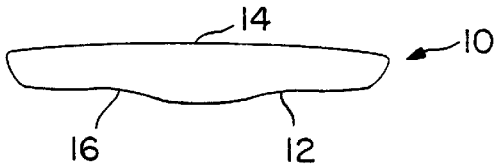
FIG. 9
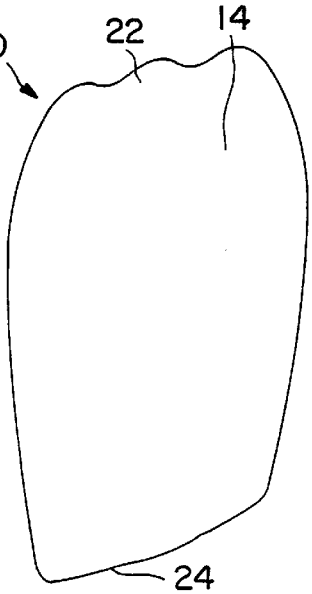
FIG. 3
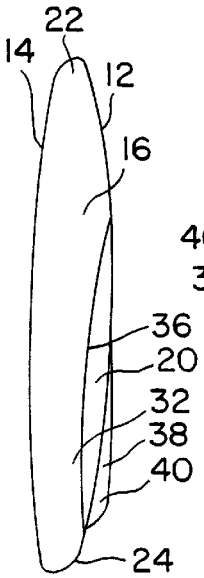
FIG. 10

BODYBOARD

BACKGROUND OF THE INVENTION

1. Field of the Invention

The present invention relates generally to the field of water sports equipment. More specifically the present invention relates to an apparatus in the form of an inventively contoured board for use in the sport of bodyboarding, originally known as "boogie boarding." The bodyboard is substantially rigid to semi-rigid and lightweight, having a durable, slick outer skin on the lower surface, a conventional upper surface. The lower surface is shaped for maximized speed, maneuverability, and performance.

In general terms, the lower surface of the bodyboard at the nose preferably has a slightly rounded or elliptical shape that is almost flat surface which changes to a shallow trimaran hull shape in the rear two thirds of the bodyboard, which, in turn, is modified by edge skegs termed infins that end abruptly before the tail. The shallow trimaran effect is tapered out so that it tends to flatten out towards the tail.

In technical terms, the lower surface can be described as including a central hull like a trimaran sailboat, and two side hulls that have a lesser draft than the central hull so when a rider leans left or right, about one third of the bodyboard comes out of water. This reduces friction and increases speed. The central hull is the main action point for the bodyboard, in part because it stays in contact with the water at virtually all times.

Starting at the nose of the bodyboard the central hull will increase the degree of dead rise (in relation to the side hulls) as it progresses towards the tail, with an almost flat bottom that is referred to as an elliptical shape in its onset at the nose of the bodyboard. Moving port and starboard from the central hull the bodyboard moves up gradually then reaches an even deeper inverse dead rise section, like an inverse chine, following the inverse down on a slightly outward slope, the bodyboard then reaches a flat section referred the side hulls. Between the central hull and the side hull a channel was formed this channel starts gradually inward at the nose of the bodyboard and then deepens toward the middle then tapering down towards the tail of the bodyboard, causing a planing effect and lift similar to trim tabs.

The inverse chine has a twofold effect, working with the main channels it deepens and shallows like the main channel trapping air, water and providing lift, as well as providing the side hulls with a sharp inward edge for grip and tracking. The side hulls have a protrusion, termed an infin, that starts about two-thirds way from the nose to the tail on the outer edge of the bodyboard and projects gradually further from the side hull lower surface and then abruptly terminates a few inches from the tail. On the inside of the infin the hull has a step down, that channels more water to the protrusion which provides the bodyboard incredible hold and eliminates slide out, and keeps the tail loose.

The combination of features, water and foam trapping, lifting surfaces, reduced friction and integrated infin design contributes to improved speed and maneuverability, improving performance in competition maneuvers such as air reverse 360 s, backflips, reverse el rollos, double el rollos, air roll spins or A.R.S. The infins also have a lesser draft than the central hull to keep the dead rise effect already described. The infins are most effective during a turn or when the bodyboard is traversing left or right on a wave, when about one third of the bodyboard on the high side is out of the water. The rear edge of the bodyboard is curved forwardly to further minimized drag, and the front edge of the bodyboard is curved forwardly for improved wave penetration. Finally, when traversing the bodyboard from nose to tail, the center portion has the greatest draft giving the bodyboard a rocker effect.

2. Description of the Prior Art

There have long been buoyant panels or boards for supporting a person as the board glides over the surface of water. These have included bodyboards, which have taken the form of substantially rectangular, flexible panels having curved ends and smooth, continuous bottom surfaces. A few had rounded channels recessed longitudinally into the middle of their lower surfaces. It is believed that the first body boards were produced commercially in 1971. These were only crude approximations of the bodyboards known today. As the demand for bodyboards increased, manufacturing refinements were made and the bodyboards achieved the generally standard form seen today. Examples of recent prior art bodyboards are the OCEAN & EARTH SPIDER™, the MANTA™ series, and the WAVE REBEL PRO D2™. These bodyboards are generally made of open and closed cell polyfoam with a plastic bottom, one such foam being ARCEL™. A problem with these prior bodyboards is that their flat, smooth lower surfaces produce extensive wetted surface areas which maximize drag. The inclusion of rounded channels, in itself, did not solve this problem. Furthermore, their flexibility caused them to dig into the water, further increasing drag.

It is thus a principal object of the present invention to provide a bodyboard which substantially reduces wetted surface area for less friction and thereby provides enhanced speed.

It is another object of the present invention to provide such a bodyboard which includes surface contours that result in enhanced maneuverability and grip.

It is still another object of the present invention to provide such a bodyboard which produces enhanced lift and and floatation.

It is finally an object of the present invention to provide such a bodyboard which accomplishes these objectives for substantially the same manufacturing cost as most prior bodyboards.

Other objects and advantages will become apparent to those skilled in the art upon reference to the following descriptions and attached drawings.

SUMMARY OF THE INVENTION

The present invention accomplishes the above-stated objectives, as well as others, as may be determined by a fair reading and interpretation of the entire specification.

A bodyboard is provided, including a bodyboard having an upper surface and a lower surface, a nose and a tail, the bodyboard lower surface at the nose having a slightly rounded or elliptical shape that is almost a flat surface which changes to a shallow trimaran hull in the rear two thirds of the bodyboard, which, in turn, is modified by edge skegs termed infins that end abruptly before the tail. The shallow trimaran effect is tapered out so that it tends to flatten out towards the tail to achieve planing effects and lift.

The bodyboard is substantially rigid to semi-rigid and light-weight, having a durable, slick outer skin on the lower surface, and a conventional upper surface. The trimaran effect combines a central hull and two side hulls. The side hulls are higher in relation to the central hull so when a rider leans left or right, about one third of the bodyboard comes out of water which reduces friction and increases speed. The inside edges of the side hulls terminate in a sharp lip, termed an inverse chine, which has a gripping effect for maneuverability. The inverse chine has another effect, i.e., it deepens and shallows like the main channel trapping air, water and providing lift.

BRIEF DESCRIPTION OF THE DRAWINGS

FIG. 1 is a perspective bottom view of the preferred bodyboard, showing the two channels and middle keel protrusion.

FIG. 2 is a side view of the bodyboard of FIG. 1, showing one of the two infins near in proximity to the tail of the bodyboard.

FIG. 3 is a perspective top view of the bodyboard showing the conventional upper surface thereof.

FIG. 4 is a front view of the bodyboard showing the flattened oval shape of the bodyboard at its front end.

FIG. 5 is a rear view of the bodyboard showing a trace of the shallow trimaran effect tapered out to achieve a fixed trim tab and the infins in proximity to the tail of the bodyboard.

FIG. 6 is a cross section view of the bodyboard taken along the line 6—6 of FIG. 1 and showing the flattened oval shape of the structure near its thickest point.

FIG. 7 is a cross section view of the bodyboard taken along the line 7—7 of FIG. 1 and showing the beginning of the shallow trimaran effect in the rear of the bodyboard.

FIG. 8 is a cross section view of the bodyboard taken along the line 8—8 of FIG. 1 and showing the shallow trimaran shape near its maximum degree of dead rise.

FIG. 9 is a cross section view of the bodyboard taken along the line 9—9 of FIG. 1 and showing a trace of the shallow trimaran effect tapered out to achieve a fixed trim tab and demonstrating that the infins do not extend all the way to the tail of the bodyboard.

FIG. 10 is a longitudinal cross section view of the bodyboard taken along the line 10—10 of FIG. 1 and showing the depth of the channel portion of the shallow trimaran, the proximity thereto of the infin, and the slightly outward slope of the channel to achieve the fixed trim tab effect.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Reference is now made to the drawings, wherein like characteristics and features of the present invention shown in the various figures are designated by the same reference numerals.

Referring to FIGS. 1–10, a bodyboard 10 is disclosed for use in the sport of body boarding. This sport involves, at least initially, resting the user's chest on the bodyboard, wearing swimfins to propel onto the crest of a wave and to steer the bodyboard 10, in combination with gripping the bodyboard with the hands and, for the present invention, leaning side to side to maneuver. optionally the user may ride the bodyboard in a "drop knee" posture, with one foot on the bodyboard and one knee on the bodyboard. A few highly skilled users can also ride the bodyboard standing on it as if it were a surf board.

Bodyboard 10 includes a substantially rigid to semi-rigid light-weight panel or bodyboard 10, which is roughly planar. Because the bodyboard 10 is substantially rigid to semi-rigid, a user steers by laterally tilting rather than by bending bodyboard 10, which is a departure from the prior art. Bodyboard 10 has a durable, slick outer skin 12 on the lower surface 16 and has an upper surface 14 that is conventional. The bodyboard is preferably formed of polystyrene covered by a skin of bi-directional epoxy cloth. Bodyboard 10 has a nose 22 and tail 24. The lower surface 16 of bodyboard 10 is contoured for maximized speed, maneuverability, floatation, and performance. In general terms, the lower surface 16 of the bodyboard 10 at the nose 22 is a slightly rounded or elliptical shape that is almost a flat surface 26 which changes to a shallow trimaran hull in the rear two thirds of the bodyboard, which, in turn, is modified by edge skegs termed infins 38 that end abruptly before the tail 24. The shallow trimaran effect is tapered out with a slightly outward slope 32 so that it tends to taper out towards the tail 24, which acts like a fixed trim tab to generate a planing effect and lift.

In technical terms, the lower surface 16 can be described as including a central hull 18 like a trimaran sailboat, and two side hulls 20 that are higher in relation to the central hull 18 so when a rider leans left or right, about one third of the bodyboard that is in contact with the water comes out of the water. This reduces friction and increases speed. That occurs because of the well established engineering principle that the friction of an object moving through water is, in part, a function of the wetted surface area. Therefore, removing part of the bodyboard from the water reduces the wetted surface area, reducing the friction and consequently increasing the speed. The central hull 18 is the main action point for the bodyboard 10, in part because it stays in contact with the water at virtually all times.

Starting after the almost flat surface 26 of the bodyboard 10, the central hull 18 will increase for a time the degree of dead rise (depth) in a recess referred to as a channel 36 (in relation to the side hulls 20) as the bodyboard 10 is traversed from the nose 22 towards the tail 24. However, close to the tail 24 this is tapered out by slope 32 in the manner of a fixed trim tab to generate a planing effect and lift. Moving port and starboard from the centerline of the central hull 18, the lower surface 16 of the bodyboard 10 includes channel 36 which is bordered on its outside edge 28 by a sharp inverse dead rise section referred to as an inverse chine 30. The inverse chine 30 includes a slightly outward slope, next to which are the side hulls 20 having an essentially flat surface 26.

The inverse chine 30 has a twofold effect. First, taken in combination with the channels 36, inverse chine 30 traps air and water, and provides lift. Second, it provides the side hulls 20 with a sharp inward edge for grip and tracking that greatly enhances maneuverability. The side hulls 20 have a protrusion, termed an infin 38, that starts about two-thirds way from the nose 22 to the tail 24 on the outer edge of the bodyboard and projects gradually further from the side hull 20 lower surface 16 and then abruptly terminates a few inches from the tail 24. The infins 38 provides the bodyboard 10 with incredible hold, eliminating slide out, while keeping the tail 24 loose.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A bodyboard comprising an upper surface and a lower surface, a nose and a tail, the lower surface including both a shallow trimaran shape near the tail and an elliptical almost flat shape near the nose constituting at least a third of the bodyboard's length.

2. The bodyboard of claim 1 which further comprises infins at lateral edges of the bodyboard.

3. The bodyboard of claim 1, in which the shallow trimaran shape is comprised of a center hull and sidehulls separated from each other by channels, the sidehulls having a lesser draft than the center hull.

4. The bodyboard of claim 3 which further comprises an inverse chine disposed between the channels and the sidehulls to enhance grip, tracking and maneuverability.

5. The bodyboard of claim 3, wherein leaning laterally will cause substantially one channel and adjacent sidehull to come out of the water to reduce wetted surface area and friction.

6. The bodyboard of claim 3, wherein a depth of each channel increases progressively from its forward end to a middle of the channel and includes a slope that tapers out towards the tail producing a planing effect and lift.

7. The bodyboard of claim 6 wherein the slope traps air to minimize wetted surface area and drag.

8. The bodyboard of claim 1, wherein the rear edge of the bodyboard is curved forwardly for minimized drag.

9. The bodyboard of claim 1, wherein the front edge of said bodyboard is curved forwardly for improved wave penetration.

10. The bodyboard of claim 1, wherein said bodyboard is substantially rigid such that bodyboard flexing and resultant drag are minimized.

11. The bodyboard of claim 1, wherein the lower surface further comprises a slick outer skin.

12. The bodyboard of claim 1, wherein said bodyboard is formed of polystyrene covered by a skin of bi-directional epoxy cloth.

13. The bodyboard of claim 1 wherein it is shaped such that when traversing the bodyboard from nose to tail, a center portion thereof has the greatest draft giving the bodyboard a rocker effect.

14. A bodyboard comprising:

a nose;

a tail;

an upper surface;

a lower surface including both an elliptical almost flat shape near the nose constituting at least a third of the bodyboard's length and a shallow trimaran shape near the tail having a center hull and sidehulls separated from each other by channels, the sidehulls having a lesser draft than the center hull;

infins at lateral edges of the bodyboard; and inverse chines disposed between the channels and the sidehulls.

15. The bodyboard of claim 14, wherein leaning laterally will cause substantially one channel and adjacent sidehull to come out of the water to reduce wetted surface area and friction.

16. The bodyboard of claim 14 wherein infins provide hold, eliminate slide out, and keep the tail loose.

17. The bodyboard of claim 14 wherein the inverse chine enhances grip, tracking and maneuverability.

18. The bodyboard of claim 14, wherein a depth of each channel increases progressively from its forward end to a middle of the channel and includes a slope that tapers out towards the tail producing a planing effect and lift.

19. The bodyboard of claim 14, wherein said bodyboard is substantially rigid such that bodyboard flexing and resultant drag are minimized.

20. A bodyboard comprising:

a nose;

a tail;

an upper surface;

a lower surface having both a shallow trimaran shape near the tail and an elliptical almost flat shape near the nose constituting at least a third of the bodyboard's length; and infins at lateral edges of the bodyboard that end abruptly before the tail.

* * * * *